United States Patent [19]

Vidal et al.

[11] Patent Number: 4,710,062

[45] Date of Patent: Dec. 1, 1987

[54] METAL STRIP FOR USE IN STABILIZED EARTH STRUCTURES

[75] Inventors: Henri Vidal, 8 bis, Boulevard Maillot, 92200 Neuilly-sur-Seine, France; Daniel Weinreb, Rexdale, Canada

[73] Assignee: Henri Vidal, Neuilly-sur-Seine, France

[21] Appl. No.: 881,651

[22] Filed: Jul. 3, 1986

[30] Foreign Application Priority Data

Jul. 5, 1985 [GB] United Kingdom ..... 8517152

[51] Int. Cl.[4] ..... E02D 5/20

[52] U.S. Cl. ..... 405/262; 428/573

[58] Field of Search ..... 405/262, 258; 428/573, 428/577, 583, 584, 596, 600

[56] References Cited

U.S. PATENT DOCUMENTS

| | | | |
|---|---|---|---|
| Re. 7,156 | 6/1976 | Lewis et al. | 428/600 |
| 1,516,069 | 11/1924 | Witherow | 428/600 |
| 1,878,054 | 9/1932 | Witherow | 428/577 |
| 1,923,017 | 8/1933 | Witherow et al. | 428/600 |
| 3,686,873 | 8/1972 | Vidal | 405/262 |
| 4,116,010 | 9/1978 | Vidal | 405/262 |
| 4,241,146 | 12/1980 | Sivachenko et al. | 428/600 |

FOREIGN PATENT DOCUMENTS

| | | |
|---|---|---|
| 0098825 | 1/1984 | European Pat. Off. . |
| 83/03602 | 10/1983 | PCT Int'l Appl. . |
| 193771 | of 1923 | United Kingdom . |
| 1069361 | 5/1967 | United Kingdom . |
| 1217140 | 12/1970 | United Kingdom . |
| 1324686 | 7/1973 | United Kingdom . |
| 1443167 | 7/1974 | United Kingdom . |
| 1563317 | 3/1980 | United Kingdom . |
| 2035191 | 6/1980 | United Kingdom . |
| 2115854 | 9/1983 | United Kingdom . |
| 2116093 | 9/1983 | United Kingdom . |

*Primary Examiner*—Melvyn J. Andrews
*Assistant Examiner*—John J. Zimmerman
*Attorney, Agent, or Firm*—Burns, Doane, Swecker & Mathis

[57] ABSTRACT

A rolled metal strip for use in stabilized earth structures has at periodic intervals along its length thickened reinforcement regions formed during the rolling operation. The strip is cut into required lengths such that each strip length has an end reinforced region through which an aperture is then formed to receive a bolt passing through a bracket of a facing. The strip may include transverse ribs at intervals on both faces of the strip to assist engagement with the surrounding soil.

22 Claims, 5 Drawing Figures

METAL STRIP FOR USE IN STABILIZED EARTH STRUCTURES

This invention relates to a metal strip for use in stabilised earth structures, for example of the type disclosed in GB-A-1069361.

A preferred type of strip for use in such structures is a rolled steel strip, and particularly a strip provided with transverse ribs as disclosed in GB-A-1563317. In use, the ends of the strips are attached to facing units such as those disclosed in GB-A-1324686. These facing units are interlocked to provide a generally vertical surface. The connection between a strip and a facing unit is usually formed by a fastening element such as a bolt which passes through an aperture in the strip.

In order to ensure that the aperture does not unduly reduce the tensile strength of the strip, it has been proposed in GB-A-1563317 to reinforce the end of a strip by means of welding one or more plates to the end of the strip and to form the aperture in the reinforced region. This presents a number of problems in practice, however. The general use of high tensile strength carbon steel means that welding can be difficult and the high heat required can produce crystallization having a corrosive effect. This can result in hairline cracks not visible to the naked eye. Furthermore, it is common to galvanize the steel strips but this can be difficult with welded reinforcement plates. Prior to galvanizing, the strip passes through an acid bath and it is difficult to remove all of the acid bath from between the welded plate and the strip. The presence of residual acid is undesirable and may damage the galvanization, leading to corrosion problems.

It has also been proposed in GB-A-1563317 to hot forge the end of the strip to a required configuration. However, this is a relatively expensive process and the forging may change the property of high strength steels in particular, leading to e.g. brittleness.

To deal with these problems, the invention provides a rolled metal strip for use in stabilised earth structures, which has at periodic intervals along its length thickened reinforcement regions formed during the rolling operation and each adapted to have formed therethrough an aperture suitable to receive fastening means to locate the strip in a stablised earth structure.

Thus, the strip will have reinforcement regions provided along its entire length, spaced apart by no more than the distance corresponding to one full revolution of the forming rolls. Typically, the maximum spacing would be about 1400 mm for a roll of this nominal circumference but preferably two or more reinforcement regions are provided for each revolution, thus giving spacings of e.g. 700 mm or 350 mm. Another possibility is to provide a roll of 1000 mm circumference with spacings of 500 mm between pads. Greater spacing results in lesser increase of weight per metre of the strip, and thus less use of material, but increases wastage when the strip is cut to length for use.

The rolled strip can be cut into the required lengths such that each strip length has a reinforcement region located at or near at least one end and an aperture will then be formed in the end reinforcement region. The result is that a reinforcement region is provided at or near the end of each strip length without separate forming steps after rolling.

It will be appreciated that to avoid cutting wastage in the event that reinforcement regions are required at both ends of the strip, each reinforcement region might have a longitudinal extent at least twice that required for use at one end of a strip length. In this way, a single cut through the middle of a region would ensure that each severed strip length will terminate in a suitable reinforcement region. However, since the number of reinforcement regions intermediate the ends of a strip length will not be used, it may be preferable to reduce the amount of material and have reinforcement regions of a size suitable for use at one end only. Thus, the cut would not be through the centre of the region, but would instead be made at or near one longitudinal end of the region, e.g. through the reinforcement region, or through its junction with the unthickened strip, or through the unthickened strip at a short longitudinal spacing from the reinforcement region.

Typically, a reinforcement region would be about 40 mm to 100 mm in length, and this can be compared with preferred strip cross-sectional dimensions of about 60×5 mm, 50×5 mm or 40×4 mm. Thus, the length of the reinforcement region is many times the thickness of the strip, for example of the order of 8 to 25 times the thickness of the strip. This can be contrasted with the dimensions of preferred transverse ribs as disclosed in GB-A-1563317 whose dimension in the longitudinal direction of the strip is of the same order as the thickness of the strip.

It is, in fact, preferable that the strip with reinforcement regions incorporate the transverse ribs also. For the 50×5 mm strip mentioned above, there may be ribs of, say, 3 mm high and 5 mm in the longitudinal direction of the strip. These may be provided at 50 mm intervals on both faces of the strip, with the ribs on one side offset by 25 mm with respect to those on the other. The ribs need not be provided continuously, and for ease of production will preferably not be formed in the reinforcement regions. Apart from that, the ribs could be provided in groups of say four - two on each face of the strip - spaced apart by a larger distance of 100mm or more.

The thickness of the reinforcement region will depend on the stress to be experienced in use, but for typical applications the thickness could be about 8 mm for the 5 mm thick strip. In general, the increase in thickness will be of the same order as that of the thickness of the strip. e.g. a 1.5 to 3.5 mm increase for a 4 or 5 mm thick strip. Where ribs are used, the reinforcement regions will generally give a similar increase in strip thickness to that provided by the ribs. The region preferably increases in thickness gradually at each end, preferably rising to maximum thickness over about $\frac{1}{4}$ to 1/13 of its overall length, to assist in rolling. In some instances, it may be preferably to increase the thickness of the strip in two sections. For example, the use of two generally straight sections of different gradient might minimise the effect of a sudden discontinuity during rolling.

The reinforcement region should also preferably extend generally symmetrically from both sides of the strip so as to be symmetrical about the laterally extending central plane of the strip. Otherwise, in the transition from one thickness to another the strip centre plane may shift for a short time in the rolling operation, leading to unwanted vibrations. However, absolute symmetry is not essential, so that although the increase in thickness might take place on both faces of the strip with the longitudinal profiles of the two faces being substantially the same as each other, these profiles might be longitudinally offset.

Preferably, the reinforcement regions will extend over the entire width of the strip, as any transverse ribs would also do. However, rolling of a thickened region results in a reduction of width. For the 50×5 mm strip with 8 mm thick reinforcement regions, the maximum reduction in strip width may be about 4 to 5 mm. This is acceptable.

The size of aperture which can be provided in the desired reinforcement regions will depend on many factors, but the diameter is likely to be substantially greater than the thickness of either the basic strip or the reinforcement region. Thus although the diameter of the aperture will vary it will generally be at least 10 mm. For the 5 mm strip with an 8 mm thick reinforcement region, an aperture of nominal 12.7 mm diameter may be used.

The strip may be of any suitable metal, bearing in mind the condition of forming and of use. ASTM A36 mild steel may be used, or higher strength steel such as ASTM A572, grades 40, 50, 60 or 65. Typical basic cross sections may be 40×5 mm, 60×5 mm, 50×6 mm and 50×8 mm for the ASTM A36 mild steel. With the higher strength steel, cross sections of 50×4 mm or 50×5 mm are possible and it is in the context of these that the reinforcement of the ends may be of particular importance.

The strip can be rolled using conventional apparatus but with the final rollers being suitably profiled to give the reinforcement regions. The existence of the reinforcement regions of increased thickness may have a tendency, in some cases, to cause bunching during the rolling process but since the duration of forming the reinforcement regions is relatively very short in most cases, there will generally be no insurmountable problems. It may be desirable to monitor and if necessary vary the roller drive velocity at appropriate points for example by terminating or varying the current supply in the case of electrically driven rollers. The cutting and handling of the strips subsequently may be by any convenient means. The lengths of strip cut could be e.g. from 3.5 m to 11.5 m or more. Considering that typical strips have a thickness of 4 to 8 mm, when the strips are cut to length of 3.5 m to 11.5 m, the ratio $l/t$ of the length of the strip, 1, to the thickness of the strip, t, typically lies in the range of 437.5 to 2875.

It will be seen that the process for forming strip lengths with reinforcement regions at either end, has a number of advantages over the known processes using e.g. welding. Furthermore, the strips themselves may have improved properties leading to more reliability in the stabilised earth structures themselves.

The invention also provides a stabilised earth structure including facing units to which are attached rolled metal strips as discussed herein, each strip being attached by fastening means received by the aperture formed through the strip.

An embodiment of some of the broad aspects discussed above will now be described by way of example only and with reference to the accompanying drawings, in which.

Figure 1:
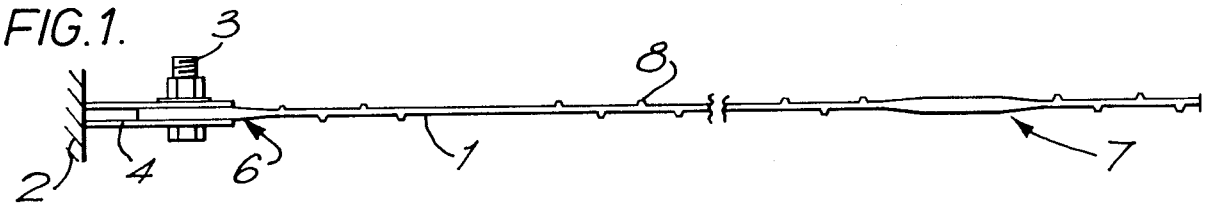
FIG. 1 is a side view of a length of strip joined to a facing element.
Figure 2:
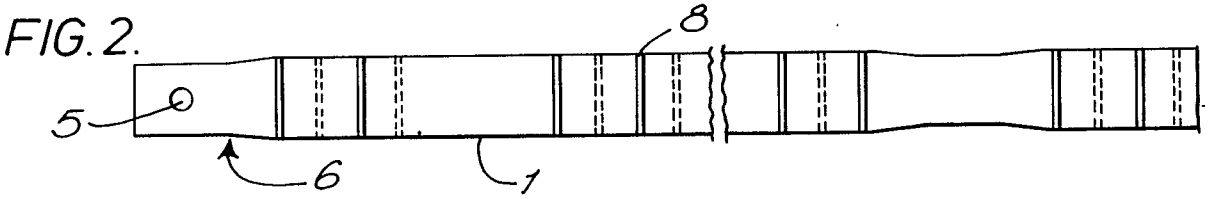
FIG. 2 is a plan view of the strip.
Figure 3:
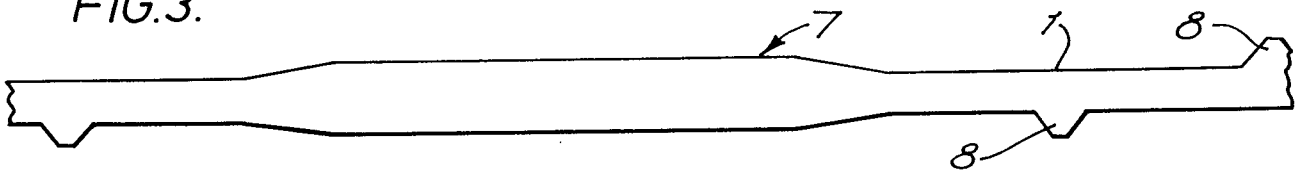
FIG. 3 is an enlarged side view of the strip.

Referring now to FIGS. 1 and 2 a strip 1 of high strength steel A572 (ASTM) is joined to a facing 2 of a stabilised earth structure by means of a bolt 3 passing through a bracket 4 secured to the facing 2 and through an aperture 5 formed in a thickened end portion 6 of the strip 1. The thickened end portion 6 is provided by the major part of one of a number of reinforcement regions 7 spaced regularly along the strip at about 700 mm intervals. The strip has a nominal thickness of 5 mm and a nominal width of 50 mm.

Each reinforcement region 7 has a maximum thickness of 8 mm for a central portion 50 mm long, and tapers at either end to the 5 mm thickness over a length of 10 mm. In an alternative embodiment the length of taper could be as little as 5 mm, while the central portion could be 55 mm long. Greater lengths of taper e.g. 25 mm are also possible. In the illustrated embodiment the tapering occurs in a single generally straight section, but it could also occur as two sections of differing gradient. The reinforcement region 7 has a reduced width, the reduction being about 5 mm maximum in the central portion. End portion 6 is formed by one tapered part and the central portion of a reinforcement region 7.

The strip is also provided with transverse ribs 8 of known type, each extending a few millimeters high and a few millimetres in the direction of the length of the strip. The ribs 8 between the adjacent reinforcement regions 7 are arranged in groups spaced apart by about 175 mm. The ribs in the groups alternate on the two faces of the strip, the spacing between two adjacent ribs being about 25 mm. There are a number of groups of four ribs and, in this arrangement, one group of three ribs between two adjacent reinforced regions.

Each reinforcement region 7, and thus end portion 6, is symmetrical having identical and aligned profiles on both faces of the strip. However, in an alternative arrangement the profiles on the two faces could be longitudinally offset relative to each other. For example there might be an offset of about 3 mm in a case where the length of taper is 5 mm.

Figure 4:
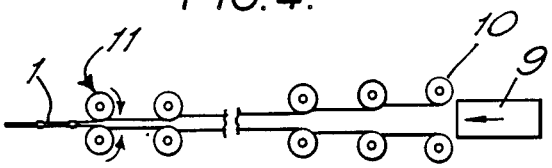
FIG. 4 is a diagrammatic view of the rolling process.
Figure 5:
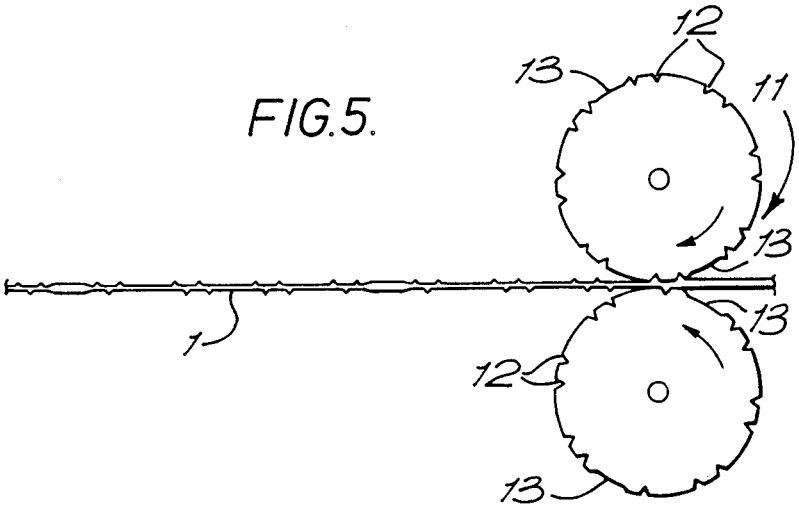
FIG. 5 is an enlarged view of the last part of the rolling process.

With reference to FIGS. 4 and 5, the strip is formed in a generally conventional manner. A hot billet 9 from a continuous casting process passes through sixteen sets of rollers 10, to produce a strip of reduced thickness. It is then passed through final profiling rollers 11 which produce the final strip 1. The circumferences of the rollers are provided with grooves 12 to produce the ribs 8 at the required intervals. However, two larger profiled regions 13 are also provided to produce the thicker reinforcement region 7. The circumference of the rollers is about 1346 mm but the strip is extruded by about 4% during rolling, so that this corresponds to about 1400 mm in the finished strip. Thus, the reinforcement regions are provided at the required intervals of 700 mm since two are formed for every rotation of the rollers.

The rolled strip is then cut into suitable lengths with a reinforcement region at one end at least constituting a thickened end portion 6 through which an aperture 5 is punched. The reinforcement regions 7 intermediate the ends are not punched. The strips can be galvanized by known means to improve corrosion resistance.

There may be a number of possible variations to the broad aspects and specific details disclosed herein and it is intended that these be included within the scope of this specification. Furthermore, this specification is relevant to the strips, the processes for forming them, and stabilised earth structures incorporating them.

We claim:

1. A rolled metal strip for use in the frictional stabilisation of earth structures, the strip being capable of sustaining tensile forces when embedded in an earth mass, the strip comprising a plurality of thickened reinforcement regions spaced at intervals along the length of the strip, said reinforcement regions being formed during the rolling of the strip and ach being between 40 mm and 100 mm in length, the strip being cut to a desired length with one of said reinforcement regions being located at or near an end of the strip, an aperture being formed through the end reinforcement region and being suitable to receive fastening means to locate the strip in a stabilised earth structure.

2. A strip as claimed in claim 1, wherein the cut is made at or near one longitudinal end of the reinforcement region.

3. A strip as claimed in claim 1, wherein the reinforcement regions increase in thickness gradually at each end thereof.

4. A strip as claimed in claim 3, wherein the increase in thickness takes place in two generally straight sections of different gradient.

5. A strip as claimed in claim 1, wherein the reinforcement regions are symmetrical about the laterally extending central plane of the strip.

6. A strip as claimed in claim 1, wherein the increase in thickness takes place on both faces of the strip, the longitudinal profiles of the two faces being substantially the same as each other but longitudinally offset.

7. A strip as claimed in claim 1, including transverse ribs provided at intervals on both faces of the strip between said reinforcement regions.

8. A strip as claimed in claim 1, wherein the strip is between 3.5 m and 11.5 m in length.

9. A strip as claimed in claim 1, wherein the reinforcment regions are spaced at intervals of between 350 mm and 1400 mm.

10. A rolled metal strip for use in the frictional stabilization of earth structures, the strip being capable of sustaining tensile forces when embedded in an earth mass, the strip comprising a plurality of thickened reinforcement regions spaced at intervals along the length of the strip and extending generally symmetrically from both sides of the strip, said reinforcement regions being formed during the rolling of the strip and each being between 40 mm and 100 mm in length, the strip being cut to a desired length with one of said reinforcement regions being located at or near an end of the strip, an aperture being formed through the end reinforcement region and being suitable to receive fastening means to locate the strip in a stabilised earth structure.

11. The metal strip of claim 10 having a thickness between 4 and 8 mm and a width between 40 and 60 mm.

12. The metal strip of claim 10 having a thickness between 4 and 8 mm.

13. The metal strip of claim 10 further including transverse ribs between the reinforcing regions, each transverse rib having a dimension, measured in the longitudinal direction of the strip, which is the same order as the thickness of the strip.

14. The metal strip of claim 13 wherein each transverse rib is about 3 mm high and about 5 mm wide, measured in the longitudinal direction of the strip.

15. The metal strip of claim 10 wherein the increase in thickness of the reinforcing region relative to the thickness of the strip is the same order as the thickness of the strip.

16. The metal strip of claim 10 wherein the aperture has a diameter of at least 10 mm.

17. The metal strip of claim 10 wherein the strip is manufactured from a metal in the group consisting of ASTM A572 steel and ASTM A36 steel.

18. The metal strip of claim 10 wherein the strip has a length, 1, and a thickness, t, and wherein the ratio of that length, 1, to that thickness, t, lies between 437.5 and 2875.

19. The metal strip of claim 10 wherein the reinforcement regions are longitudinally spaced from one another by a distance of about 700 mm.

20. The metal strip of claim 10 wherein the strip is galvanized.

21. A stabilised earth structure comprising a plurality of facing units, an earth mass behind the facing units, a plurality of rolled metal strips extending rearwardly into the earth mass from the facing units, and fastening means for attaching the strips to the facing units, wherein each said strip is capable of sustaining tensile forces to which it is subjected in the earth mass, each said strip having a plurality of thickened reinforcement regions spaced at intervals along the length of the strip, said reinforcement regions being formed during the rolling of each said strip and each being between 40 mm and 100 mm in length, each said strip being cut to a desired length with one of said reinforcement regions being located at or near an end of the strip, an aperture being formed through the end reinforcement region and receiving said fastening means to attach the strip to a respective facing unit.

22. A stabilised earth structure comprising a plurality of facing units, an earth mass behind the facing units, a plurality of rolled metal strips extending rearwardly into the earth mass from the facing units, and fastening means for attaching the strips to the facing units, wherein each said strip is capable of sustaining tensile forces to which it is subjected in the earth mass, each said strip having a plurality of thickened reinforcement regions spaced at intervals along the length of the strip and extending generally symmetrically from both sides of the strip, said reinforcement regions being formed during the rolling of each said strip and each being between 40 mm and 100 mm in length, each said strip being cut to a desired length with one of said reinforcement regions being located at or near an end of the strip, an aperture being formed through the end reinforcement region and receiving said fastening means to attach the strip to a respective facing unit.

* * * * *